United States Patent [19]

Simjian

[11] Patent Number: 4,783,075

[45] Date of Patent: Nov. 8, 1988

[54] GOLF PRACTICE PUTTING DEVICE

[75] Inventor: Luther G. Simjian, Fort Lauderdale, Fla.

[73] Assignee: Command Automation, Inc., Fort Lauderdale, Fla.

[21] Appl. No.: 165,805

[22] Filed: Mar. 9, 1988

[51] Int. Cl.[4] ..... A63B 69/36

[52] U.S. Cl. ..... 273/176 FA

[58] Field of Search ..... 273/176 F, 176 FA, 176 FB, 273/176 H, 176 E, 176 G, 176 J, 176 K, 176 L, 352

[56] References Cited

U.S. PATENT DOCUMENTS

| | | | |
|---|---|---|---|
| 2,912,248 | 11/1959 | Buono | 273/176 F |
| 3,591,176 | 7/1971 | Roth | 273/176 F |
| 4,634,130 | 1/1987 | Simjian | 273/176 FA |

*Primary Examiner*—Edward K. Look

[57] ABSTRACT

A golf practice putting device comprises an elongated mat upon which a golf ball is propelled from one end to an opposite end exhibiting a ramp surface and an abutting elevated normally level surface provided by a frame supporting the mat at such opposite end. An aperture is provided at the elevated surface and a ball entering the aperture is guided to a first receptacle in the frame where the ball is retained. Balls rolling toward the aperture but missing the aperture drop into a second open top receptacle. The first receptacle is covered by a liftable portion of the mat. For retrieving balls from the first receptacle, the mat portion covering the first receptacle is manually lifted. Means are provided on that mat portion for causing the mat to remain flat above the first receptacle despite repeated lifting and bending for ball retrieval.

10 Claims, 2 Drawing Sheets

GOLF PRACTICE PUTTING DEVICE

BRIEF SUMMARY OF THE INVENTION

This invention relates to golf practice putting devices and more specifically refers to devices of the kind wherein a golf ball is stroked for rolling over a mat toward a predetermined location which contains a cup for receiving such a golf ball. A device of the aforesaid type has been disclosed in my previously issued U.S. Pat. No. 4,634,130, dated Jan. 6, 1987, entitled, "Golf Practice Putting Device." The present invention concerns certain improvements with respect to the previously disclosed device, namely lower cost of manufacture, and secondly, providing a more pleasing appearance by visually exposing to the golf player only a single golf ball receiving receptacle while retaining the feature of two ball receiving and retaining receptacles disposed rearward of the cup shown in the above referenced patent.

As depicted in the earlier patent, a golf ball is driven along a mat over a level floor portion to a ramp surface and over the ramp surface toward an elevated substantially level surface containing and aperture simulating a regulation cup. Balls entering the aperture roll into a first receptacle and are retained therein while balls which miss the aperture and roll over the elevated substantially level surface beyond the location of the aperture fall into a second receptacle. In the present invention, as contrasted with the earlier device, the first receptable is covered by the mat providing the playing surface. However, the mat can be lifted from the first receptacle for retrieving balls retained therein. Means are attached to the underside of the mat at the location of the first receptacle for retaining the mat flat above the receptacle despite repeated bending of the mat during ball retrieval, thus presenting a smooth and flat playing surface for balls rolling along the surface toward the second receptacle.

One of the important objects of this invention, therefore, is the provision of a new and improved golf practice putting device.

Another important object of this invention is the provision of an improved golf practice putting device providing a more pleasing appearance than the device previously disclosed while retaining the two receptacle feature for separating good putts from bad putts.

Further, and still other objects and features of this invention will become more clearly apparent from the following description when taken in conjunction with the accompanying drawings.

DETAILED DESCRIPTION OF THE INVENTION

Figure 1:
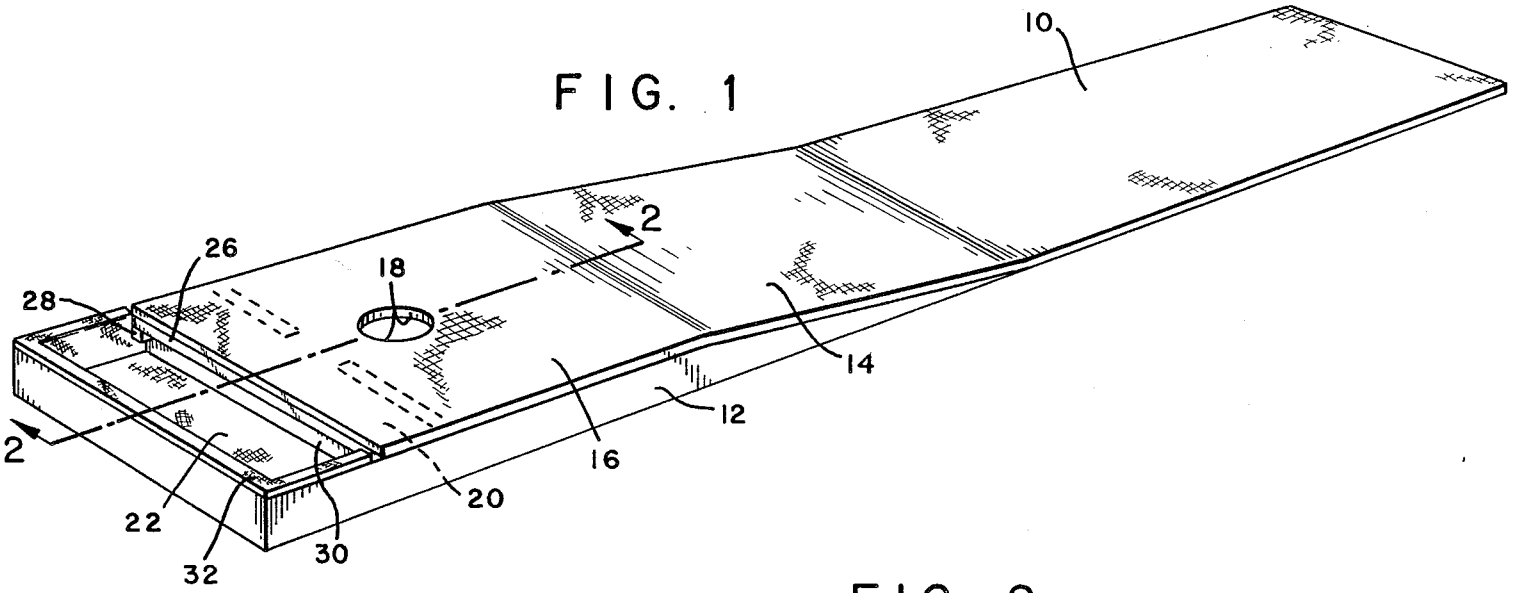
FIG. 1 is a perspective view of the golf practice putting device forming the present invention.
Figure 2:
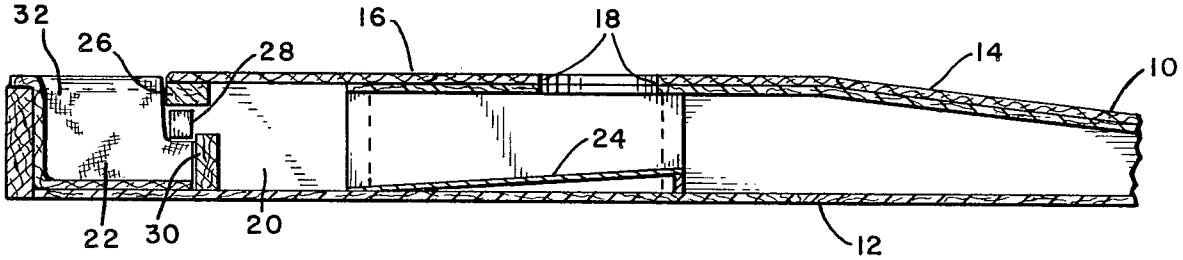
FIG. 2 is a sectional view of the device; along line 2—2 in FIG. 1.

Referring now to the figures and FIGS. 1 and 2 in particular, there is shown an elongated mat 10, constituting a playing surface, which rests with one end on a floor and which with the other end is supported on a frame 12 which provides to the mat 10 a ramp surface 14 and an abutting elevated, substantially level surface 16. The frame 12 may be made from wood, plastics or other suitable material to provide the support for the mat, i.e., the ramp surface and the elevated, substantially level surface. At the elevated substantially level surface 16 there is provided in the mat and frame an aperture 18, simulating a golf ball receiving cup. Balls received in the aperture 18 are guided into a first receptacle 20 while balls stroked and rolling over the flat portion of the mat, then upward on the ramp surface 14 and across the substantially level surface 16, but missing the aperture 18, drop into the open top second receptacle 22. It will be noted that both reoeptacles, disposed parallel to one another and disposed transverse with respect to the longitudinal axis of the mat, are of rectangular shape and with open top, although during playing, in order to present to the player a visually pleasing surface, the first receptacle 20 is covered by a removable portion of the mat 10. The mat, except for the portion covering the receptacle 20, preferably is adhesively fastened to the frame 12.

Figure 3:
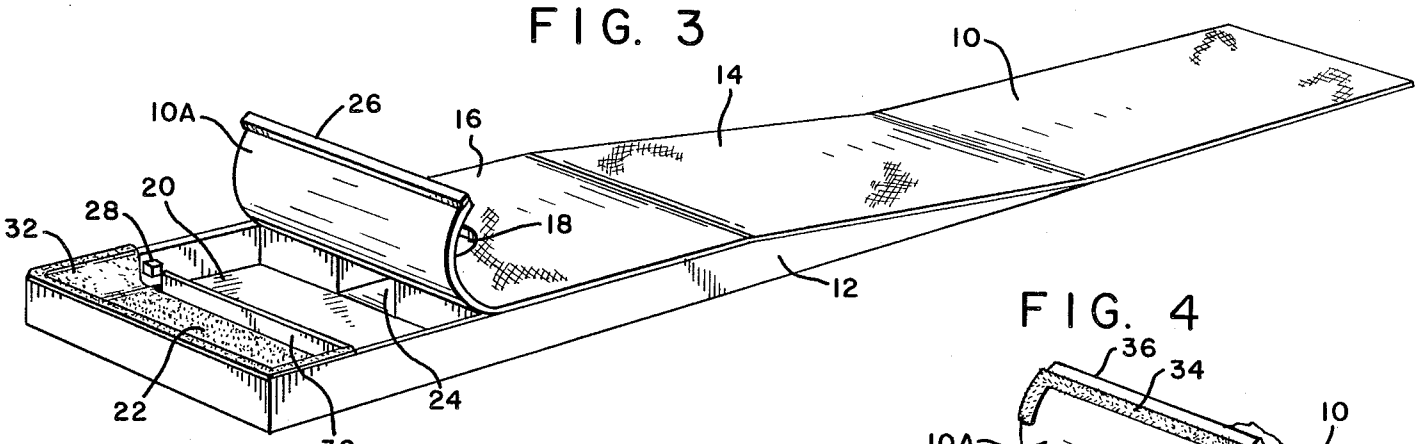
FIG. 3 is a perspective view, similar to FIG. 1, but showing the mat lifted from the first receptacle.

Referring now to FIGS. 2 and 3, certain important details of the present invention are shown in greater detail. Balls entering the aperture 18 are guided by guide means 24, an inclined plane, to the first receptacle 20 from which the balls are retrieved by briefly lifting the mat portion 10A from the receptacle 20, see FIG. 3. In order to retain the mat portion 10A in a smooth and flat condition without curling above the receptacle 20, despite repeated bending and lifting, the underside of the mat is provided with a stiffening or weight means 26, such as a tranverse wooden bar, bonded or stapled to the underside of the mat. The weight means comes to rest on a pair of stops 28, only one being visible in FIG .3. The stops are disposed slightly to the rear of the receptacle dividing wall 30 to cause the mat end to overhang the dividing wall in order to readily permit the mat end to be grasped from the receptacle 22 and lifted from the receptacle 20 as shown in FIG. 3. When the mat portion 10A is covering the receptacle 20, the mat is flat and provides a continuous level surface for balls rolling over the surface 16. In order to provide a pleasant feel, the bar 26 may be wrapped with mat material or other textile material. In order to provide a pleasing appearance, the open top receptacle 22 as well as its top edge may be lined with mat material 32 as shown in FIG. 3.

Figure 4:
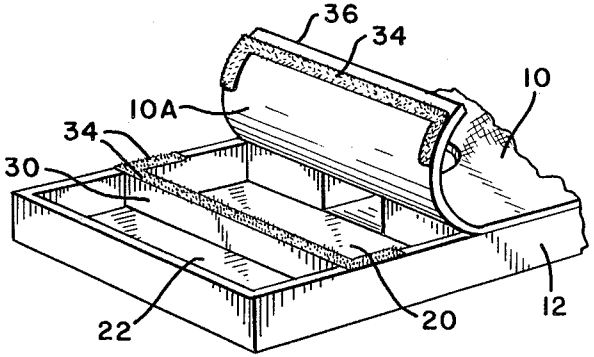
FIG. 4 is a perspective view showing an alternative embodiment for securing the mat above the first receptacle.

FIG. 4 shows an alternative construction for retaining the mat 10 flat and taut above the receptacle 20. The top of the frame 12 near the receptacle 20, the dividing wall 30 and the underside of the mat portion 10A are provided with complementary strips 34 of the commercially available "Velcro" fastener material. Thus, the mat portion 10A can be securely, yet removably, be retained above the receptacle 20. It will be observed that in FIG. 4, the dividing wall 30 is raised with respect to the embodiment shown in FIG. 3 to cause the mat to provide a level surface. Also, it will be noted that the end 36 of the mat is constructed to overhang the dividing wall 30 when the mat covers the receptacle 20 in order to provide an area for grasping the mat and accommodate its lifting.

Figure 6:
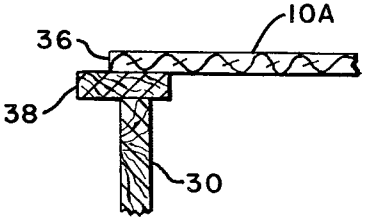
FIG. 6 is a sectional view of details pertaining to the modification shown in FIG. 5.
Figure 5:
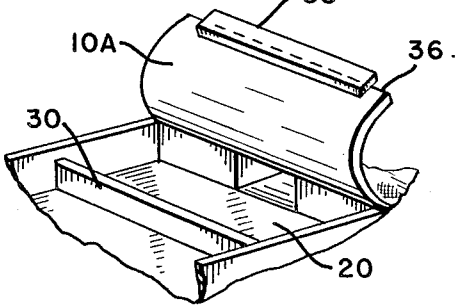
FIG. 5 is a perspective view of another modification for holding the mat in a flat condition above the first receptacle.

FIG. 5 and 6 disclose a further modification. The underside of the mat portion 10A is provided with a stiffening and weight bar 38 which overhangs the end 36 of the mat. The bar 38 is adapted to rest on the dividing wall 30 but overhangs it as seen in FIG. 6. For lifting the mat portion 10A, the overhanging bar 38 can be grasped and the mat lifted and bent back from the receptacle 20 as seen in FIG. 5.

In a still further embodiment, not depicted, commercially available snap fasteners between the frame and the mat may be used for retaining the mat taut and level above the receptacle 20.

For putting practice, as in my previously issued U.S. patent, one or more players putt a golf ball across the mat from the end opposite the aperture 18 and receptacles 20 and 22 toward the aperture 18. The aim, as in the actual golf game, is to have the ball enter the aperture 18 simulating a cup. Balls entering the aperture 18 fall into the receptacle 20 and are retained therein. Balls missing the aperture are received in the receptacle 22 and are retained therein. When all balls have been used, the balls are retrieved from the respective receptacles and put back into play. As disclosed and shown in U.S. Pat. No. 4,634,130 counting means may be used with the receptacles for automatically developing a count of balls entering the respective receptacles.

While there has been described and illustrated a preferred embodiment of my invention and certain modifications thereof, it will be apparent to those skilled in the art that additional changes and modifications may be made therein without departing from the principle of this invention which shall be limited only by the scope of the appended claims.

I claim:

1. A golf practice putting device comprising:

a frame providing a ramp surface and an abutting elevated substantially level surface;

a first and second open top golf ball receiving receptacle located within said frame at said substantially level surface in proximity to the frame end opposite the abutment of said ramp and level surfaces;

an elongated mat covering said ramp surface and covering said abutting elevated surface including covering said first receptacle but leaving said second receptacle uncovered;

a golf ball receiving aperture disposed in said mat and frame on said elevated surface at a position forward of said receptacles in relation to a ball rolling upward on said ramp surface and over said level surface toward the position of said receptacles;

means communicating with said aperture and said first receptacle for guiding a golf ball entering said aperture into said first receptacle;

said mat being liftable from said first receptacle for exposing and retrieving golf balls disposed in said first receptacle; and means attached to the underside of said mat in proximity to the area of said first receptacle for causing said mat to lie flat over said first receptacle;

whereby golf balls rolling over said ramp surface and said elevated surface but failing to enter said aperture roll over said first receptacle and drop into said uncovered second receptacle.

2. A golf practice putting device as set forth in claim 1, said receptacles being of substantially rectangular shape disposed transverse with respect to the longitudinal axis of said mat.

3. A golf practice device as set forth in claim 1, said means attached to the underside of said mat comprising a stiffening bar.

4. A golf practice putting device as set forth in claim 3, said stiffening bar adapted to rest on stops disposed on said frame.

5. A golf practice putting device as set forth in claim 3, said stiffening bar adapted to rest on a dividing wall separating said first receptacle from said second receptacle when said mat covers said first receptacle.

6. A golf practice putting device as set forth in claim 5, said bar overhanging said wall into said second receptacle for being grasped from said uncovered second receptacle for lifting said mat from said first receptacle.

7. A golf practice putting device as set forth in claim 1, said means attached to the underside of said mat comprising fastening means, and complementary fastening means disposed on said frame.

8. A golf practice putting device as set forth in claim 7, said fastening means comprising strips of "Velcro" fastening means.

9. A golf practice putting device as set forth in claim 1, said second receptacle being lined with mat material.

10. A golf practice putting device as set forth in claim 1, said means communicating with said aperture and said first receptacle comprising an inclined plane.

* * * * *